US005125353A

United States Patent [19]

McGuinness

[11] Patent Number: 5,125,353

[45] Date of Patent: Jun. 30, 1992

[54] METHOD AND MEANS FOR PREVENTING LEAKS FROM A LIQUID-BULK CARRIER CARGO SHIP

[76] Inventor: Gerard E. McGuinness, #59-2470 Headon Forest Dr., Burlinton, Ontario, Canada, L7M 3P2

[21] Appl. No.: 697,671

[22] Filed: May 9, 1991

[51] Int. Cl.[5] ..... B63B 25/12; B63B 43/16

[52] U.S. Cl. ..... 114/74 R; 114/228

[58] Field of Search ..... 114/227, 229, 228, 74 R, 114/74 A, 747; 210/923

[56] References Cited

U.S. PATENT DOCUMENTS

| | | | |
|---|---|---|---|
| 2,991,906 | 7/1961 | Eligoulachvili | 114/74 R |
| 3,508,652 | 4/1970 | Woolley | 210/293 X |
| 3,906,880 | 9/1975 | Hebert | 114/68 |
| 4,038,182 | 7/1977 | Jenkins | 210/293 X |
| 5,060,589 | 10/1991 | Winckelmann | 114/74 R |

*Primary Examiner*—Sherman D. Basinger

*Attorney, Agent, or Firm*—Terry M. Gernstein

[57] ABSTRACT

A rupture in a portion of the cargo hold area of a liquid-bulk carrier cargo ship is closed by inserting a flexible, liquid-tight bag through a hatch into the hold, then pumping fluid contained in the hold back into the bag to deploy the bag. The pumping is continued until the bag has deployed far enough to cover the rupture. Such covering prevents further leakage of the cargo out of the hold. The preferred form of the invention includes the use of the ship's pumping system; however, alternative forms of the invention include self-contained units. The preferred form of the bag includes Spectra material.

11 Claims, 6 Drawing Sheets

METHOD AND MEANS FOR PREVENTING LEAKS FROM A LIQUID-BULK CARRIER CARGO SHIP

TECHNICAL FIELD OF THE INVENTION

The present invention relates to the general art of cargo shipping, and to the particular field of preventing damage due to leaks in liquid cargo ships.

BACKGROUND OF THE INVENTION

Spillage of liquid from liquid-bulk carrier cargo ships has been a problem since the first liquid-bulk carrier cargo ship was launched. However, in recent times, such problem has become extremely noticeable and has created several environmental disasters. This is particularly true when the liquid cargo is oil or other such product that has the potential to inflict great harm on the environment.

Typically, a liquid-bulk carrier cargo ship includes at least one large liquid containing hold that is partly formed by at least a portion of the ship's hull. These ships generally have an onboard pumping system for loading the liquid cargo into the hold and for offloading the cargo from the hold at the ship's destination. The pumping system thus includes a fluid connection into the cargo hold and a conduit that can be fluidically connected to a facility that is spaced from the ship, such as an onshore storage facility or the like.

One common cause of the aforementioned cargo spillage is the rupturing of the ship's hull. This rupturing can result from numerous causes, such as collision, weakening of the hull structure, or the like. Whatever the cause, the rupture may result in great quantities of the liquid cargo spilling out of the ship and into any body of water in which the ship is located at the time.

Due to the problem with spills, the art has included several designs intended to contain the spilled product. Such designs have included portable booms that are deployed around the spill, inflatable mechanism, and the like. While somewhat successful in many situations, most of these device have several drawbacks. One such drawback results because the device must be brought to the spill site from somewhere else. In the time that the device is being transported to the spill site, great damage can be done. In fact, many of the most damaging spills have occurred because the leaking ship was permitted to leak for several days until proper containment mechanisms were moved into the vicinity of the ship.

Another drawback is directly related to the very nature and principles of the devices. These devices are intended to contain a spilled product in a particular area after the liquid has already spilled from the ship. Weather or other conditions may inhibit the effectiveness of such devices. Furthermore, even if the devices are effective, the cargo is still in the water and may create great problems, even if it is contained to a specific area and location.

Still further, since these devices are intended to be deployed outside of the ship, they may be subjected to difficult and harsh weather conditions. Such conditions may make deployment of the containment device difficult or ineffective.

Therefore, there is a need for a device and a process for preventing a rupture in a ship from allowing any liquid cargo from causing great damage to the water in which a liquid-bulk carrier is located, yet which is efficient to store and deploy, and which will not be unduly sensitive to weather or sea conditions. Most specifically, there is a need for a device and process for preventing a rupture in a liquid-bulk ship hull from allowing liquid cargo to leak out of the ship in the first place and which can be stored on the ship and deployed within an area that is not subjected to weather conditions.

OBJECTS OF THE INVENTION

It is a main object of the present invention is to provide a device and process for preventing a rupture in a ship from allowing liquid carried in a liquid-bulk carrier from causing damage to the water in which the ship is located.

It is another object of the present invention to provide a device and process for preventing liquid in a liquid-bulk carrier ship from leaking out of the hold of such ship due to a rupture in the hull of such ship.

It is another object of the present invention to provide a device and process for preventing liquid in a liquid-bulk carrier ship from leaking out of the hold of such ship due to a rupture in the hull of such ship using a device which can be stored onboard the ship at all times.

It is another object of the present invention to provide a device and process for preventing liquid in a liquid-bulk carrier ship from leaking out of the hold of such ship due to a rupture in the hull of such ship using a device which can be stored onboard the ship at all times and which can be deployed inside the ship.

SUMMARY OF THE INVENTION

These, and other, objects are achieved by a process and device which is carried onboard a liquid-bulk cargo ship which has a cargo hold defined, at least in part, by a portion of the ship's hull. The device is deployed from inside the cargo hold, and thus will not be subject to weather conditions, and can prevent the liquid cargo from entering the water in which the ship is located. Therefore, the containment process can be extremely effective, rapid and not subject to the vagaries of weather conditions. Since the liquid is actually prevented from entering the water, the problems associated with such liquid in the water are avoided.

The process includes placing a liquid-proof bag into the cargo hold through a hatch, connecting the ship's pumping system to that hatch, and pumping the liquid from the cargo hold back into that same hold, but into the bag. The bag expands into the liquid remaining in the hold, and continues to expand until at least a portion of the bag reaches the rupture in the hull. The bag then seals over that rupture and prevents further liquid from flowing out of the ship via the rupture.

Alternative forms of the invention include pumping mechanisms associated with the bag to move the liquid into the bag without the need of using the ship's pumping system. One form of the bag includes Spectra fibers.

BRIEF DESCRIPTION OF THE DRAWING FIGURES

DETAILED DESCRIPTION OF THE PREFERRED EMBODIMENT OF THE INVENTION

Figure 1:
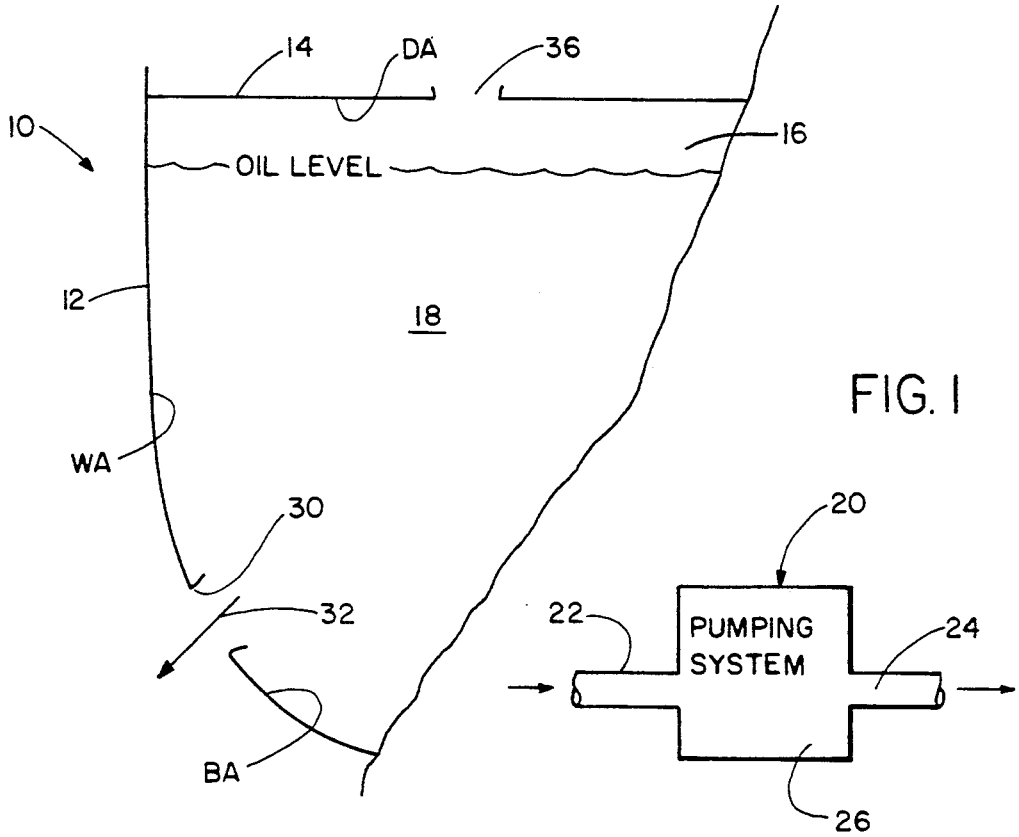
FIG. 1 illustrates a portion of a liquid-bulk carrier cargo ship in conjunction with a ship's pumping system, with a rupture in a portion of the ship's hull adjacent to the cargo hold in which liquid is being stored.
Figure 2:
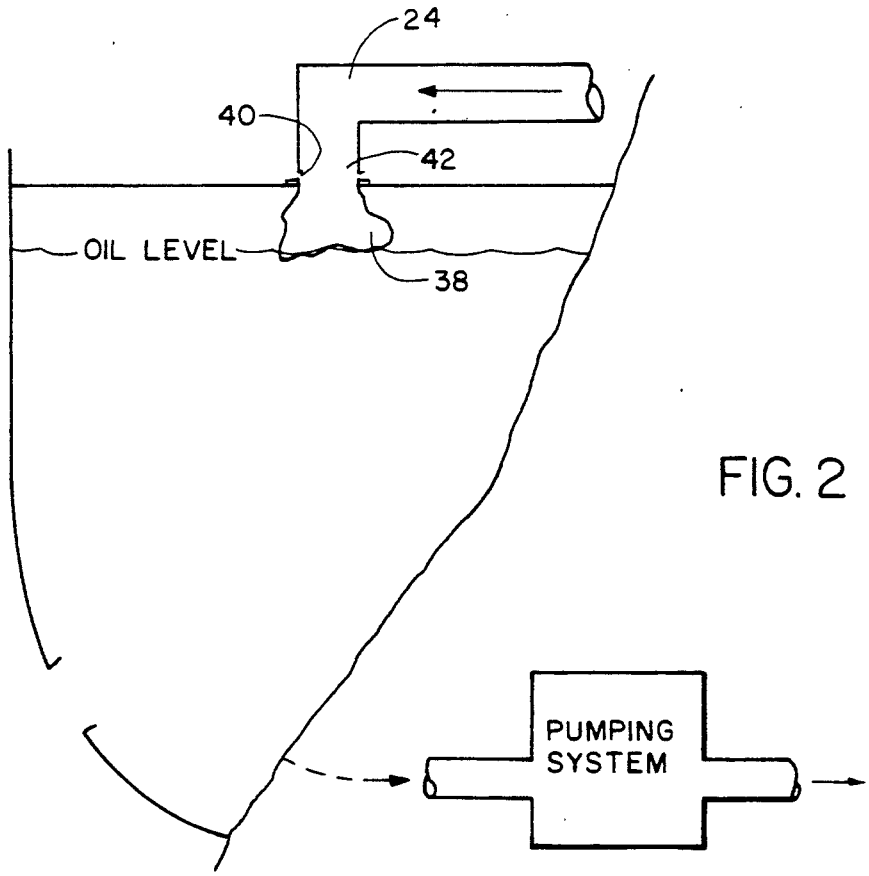
FIG. 2 illustrates initial deployment of a system which will eventually seal the rupture in the hull and which will prevent undue leakage of liquid out of the ship.
Figure 3:
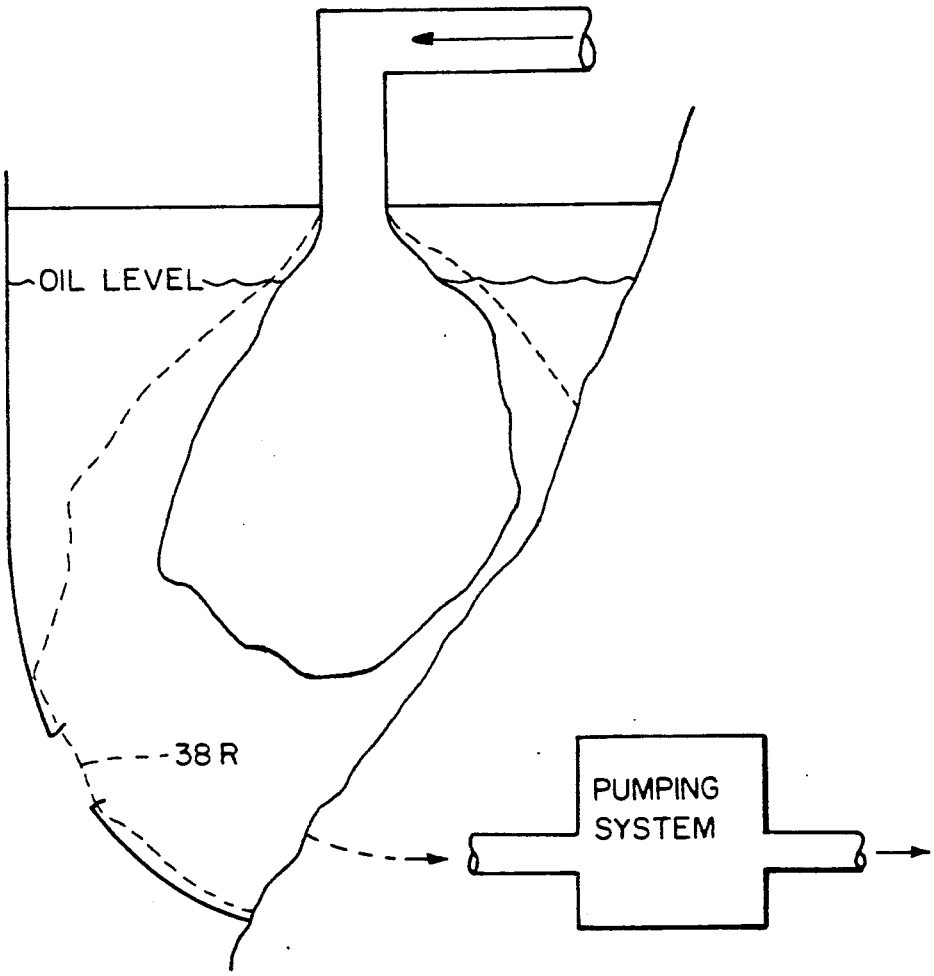
FIG. 3 illustrates the rupture sealing mechanism in a nearly deployed configuration.

FIGS. 1-3 illustrate the basic method embodying the present invention. The method serves to seal a rupture in the hull of a liquid-bulk carrier cargo ship from within the ship and thereby prevent the liquid in the ship from leaking out of the ship. The preferred form of the method utilizes the pumping system associated with loading and offloading the cargo.

As shown in FIGS. 1-3, the ship 10 includes a hull 12 having a deck 14 which co-operate to define at least a portion of a cargo hold 16. Liquid, such as oil 18, or the like, is stored in the hold 16. The ship includes a pumping system 20 for loading the liquid onto the ship and for offloading the cargo from the ship. The pumping system includes an offloading conduit 22 fluidically connected at an inlet end thereof to the fluid 18, and an onloading conduit 24 fluidically connected at one end to the pumping system pumps and control mechanism 26 and having a second end that is connectable to a storage facility spaced from the ship. The pumping system 20 is illustrated in FIG. 1 in the offloading mode of operation. However, the onloading mode of operation simply reverses the flow directions and operations shown in FIG. 1. The details of the pumping system operation will not be discussed as those skilled in the art will understand such details.

Also illustrated in FIGS. 1-3 is a rupture 30 in the hull 12. This rupture produces a fluid path from the interior of the cargo hold 16 to the exterior of the ship whereby fluid 18 can flow out of the hold via the rupture as indicated by arrow 32. This fluid flows into the environment surrounding the ship, and can create great damage and problems. Accordingly, the present invention is embodied in a method and a means for sealing the rupture 30 from within the ship in a manner that prevents great quantities of liquid 18 from flowing out of the ship.

The method includes opening a tank hatch 36 through the deck 14 adjacent to the cargo hold in which the rupture is located and near the rupture 30. A flexible, fluid-proof bag 38 is moved through the open hatch. The preferred form of the fluid-proof bag includes Spectra fibers and is strong enough to withstand the pressures and forces that will be exerted on that bag. The bag is folded in the manner of a parachute, and is large enough to cover a great portion of the cargo hold 16. The bag must at least be large enough to have one portion thereof reach from the tank hatch 36 to the hull and cover the rupture 30. That is, since most cargo holds have at least one hatch associated therewith, the bag should be at least long enough to reach from the center of the cargo hold to each end of the hold on the bottom floor of the hold from the top of the hold where the hatch is located. The preferred form of the bag has the bag equal in surface area, when totally deployed, to the total interior wall surface area of the cargo hold. The total interior wall surface area of the cargo hold includes the total wall surface area, plus the total deck surface area, plus any bottom surface area associated with the hold. As shown in FIG. 1, the deck surface area is indicated at DA, the wall surface area is indicated at WA and the bottom surface area is indicated at BA. The wall and bottom surface area also includes the surface area of the end walls that are not shown in FIG. 1. In this manner, the bag will be able to contain the entire contents of the hold 16.

The bag includes a mouth 40 that is positioned within the tank hatch to open outwardly of the cargo hold via the tank hatch. In position, the bag is located inside the cargo hold, in a folded condition and has the inside of the bag exposed to the environment via the tank hatch with the outside of the bag in engagement with the fluid 18. The tank hatch is thus closed off from the liquid 18 by the bag.

The offloading conduit 24 of the ship pumping system is fluidically connected to the interior of the bag. This connection can be achieved by coupling the conduit 24 to the hatch by a suitable coupling ring 42, or the like. In this manner, the liquid 18 in the cargo hold 16 is fluidically connected to the interior of the bag 38 via the ship's pumping system.

The pumping system is started, and fluid 18 from the cargo hold 16 is transferred into the bag 38. As this fluid transfer occurs, the bag expands. Due to the weight of the fluid, the bag moves downwardly toward the bottom of the hold as indicated in FIG. 3. If necessary, some form of weight can be added to the bag prior to initiating the pumping process to ensure the downward movement of the bag.

After some time of filling, at least a portion of the bag 38 approaches and covers the hull 12 due to the continued expansion of the bag as fluid 18 is moved into the bag. A concomitant rearrangement of the fluid 18 in the cargo hold occurs as fluid moves into the bag.

Eventually, some part of the bag covers the rupture 30. This covering of the rupture seals that rupture and causes the leaking of fluid from the cargo hold to cease. This condition is illustrated in FIG. 3 by the dotted line configuration of the bag 38. The rupture is covered by bag portion 38R, and the bag is formed of material that is strong enough to prevent the bag from tearing due to the pressure on the bag by the fluid 18 or due to contact with various support elements and structures located within the cargo hold as the bag expands. It is noted that the pressure differential existing across the bag adjacent to the rupture will not be large as water is located on one side of the bag and liquid 18 is on the other side of the bag. The pressure difference across the bag is related to these two fluids and the pumping pressure applied to the fluid 18. The combined pressures will generally not be great enough to damage the bag.

Once the rupture is sealed, the ship can be towed to safety or can wait for other assistance. At any rate, no further liquid will be spilled from the ship.

Figure 4:
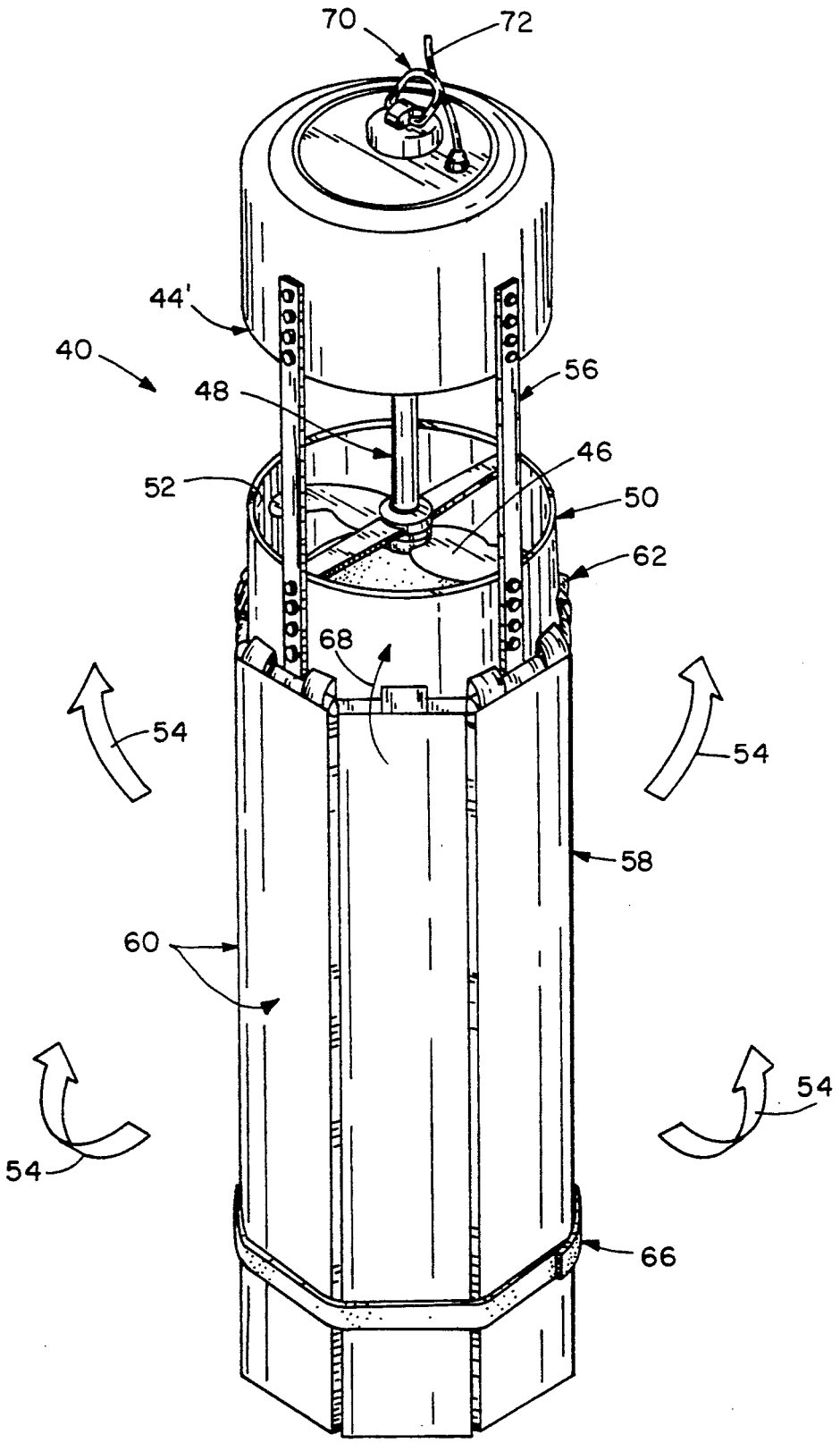
FIG. 4 is a perspective view of an alternative form of rupture sealing mechanism which includes a pumping system.
Figure 5:
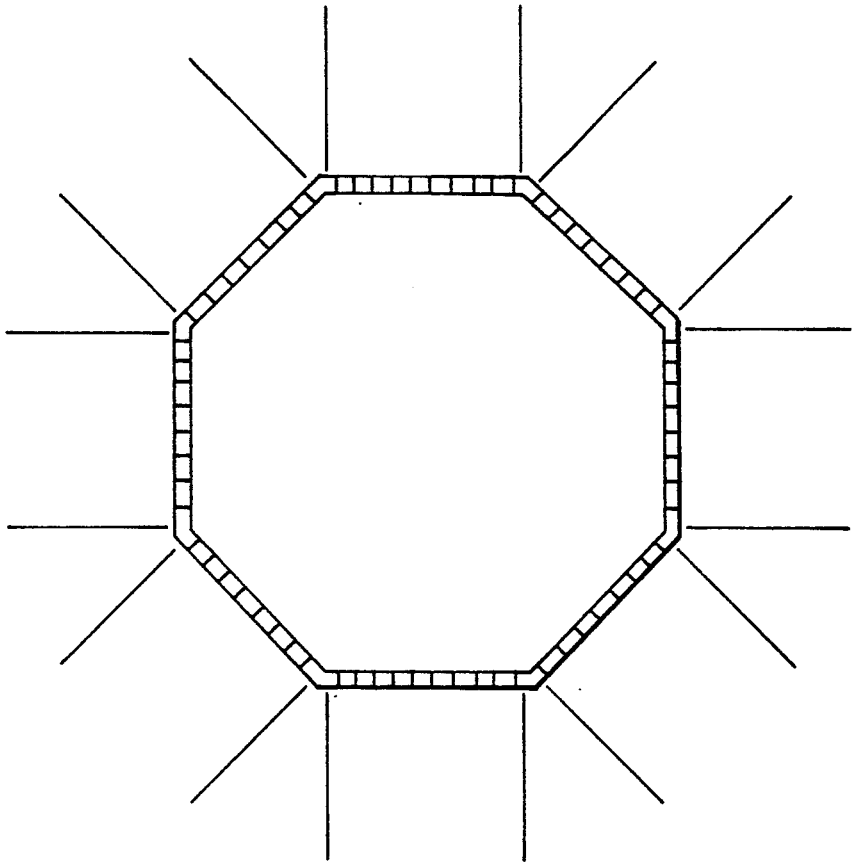
FIG. 5 is a schematic top view of the FIG. 4 mechanism in a partially deployed configuration.
Figure 6:
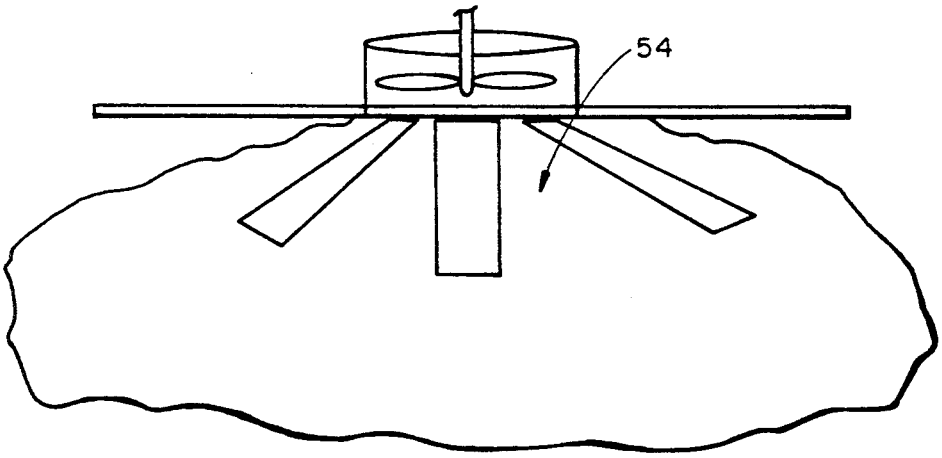
FIG. 6 is a side elevational view of the FIG. 4 mechanism in a partially deployed configuration.

A self-contained unit 40' is shown in FIG. 4. This unit 40' does not require use of the ship's pumping system since the unit 40' includes a motor 44 that drives a propeller 46 via a shaft 48. The propeller is located in a housing 50 having an inlet 52 through which fluid 18 moves as indicated by arrows 54. Straps 56 attach the motor to the housing. The flexible bag is stored in a portion 58 of the unit. The portion 58 includes a plurality of panels 60 hingeably attached to the housing by hinges 62 and which are held in the FIG. 4 storage position by a strap 66 encircling such panels. The strap has its ends connected together by a releasable fastener, such as VELCRO or the like. As the bag expands under the influence of fluid being pumped thereinto, the bag forces the panels to move upwardly as indicated in FIG. 4 by arrow 68. This pressure overcomes the closing force of the strap fastener, and the panels move upwardly as the bag continues to expand. This action is indicated in FIGS. 5 and 6.

The unit 40 is attached to the deck adjacent to the hatch 36 by means of a hook support 70 after being lowered into the cargo hold. The motor is attached to a power source (not shown in FIG. 4) by a power cord 72.

Figure 7:
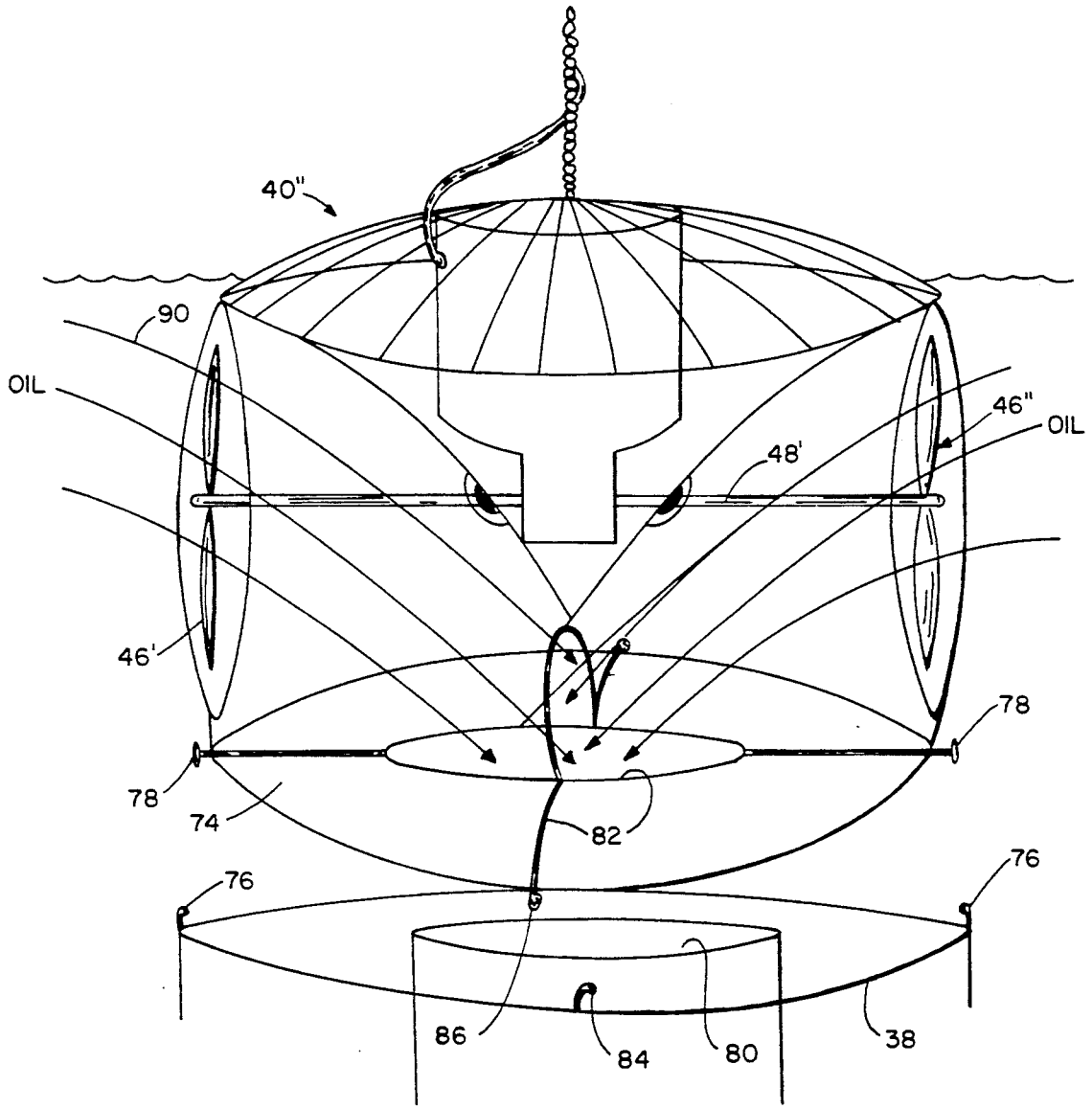
FIG. 7 illustrates another alternative form of the rupture sealing mechanism in which two inlets are included.
Figure 8:
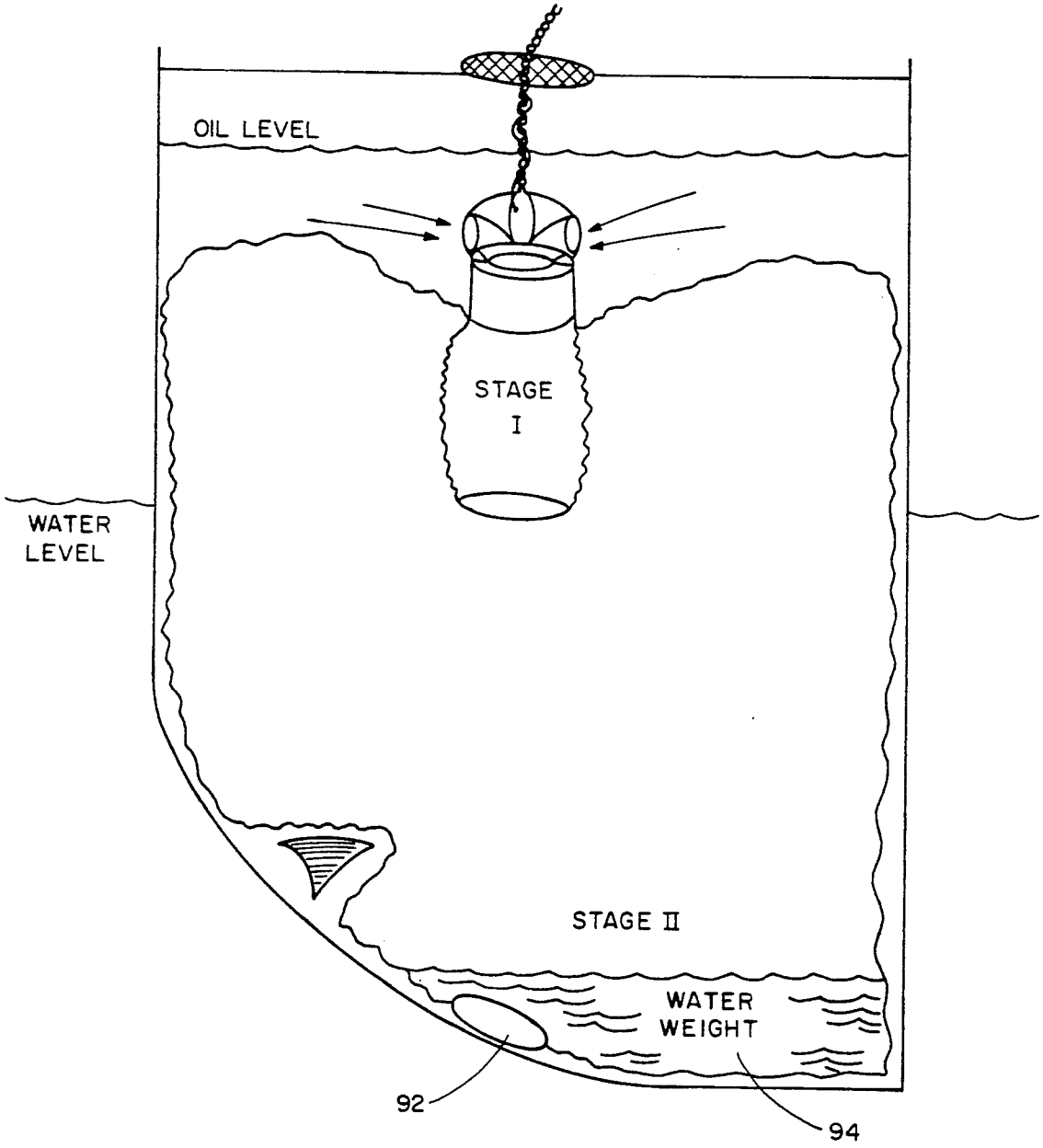
FIG. 8 illustrates the FIG. 7 form of the mechanism in a partially deployed condition and in a fully deployed condition.

A further alternative form of the unit is illustrated in FIGS. 7 and 8 as unit 40''. The unit 40'' is also self-contained and does not rely on the ship's pumping system to operate. Such self-contained units may be necessary if the ship's pumping system is damaged or down due to a collision or the like.

The unit 40'' is similar to the unit 40 except that the unit 40'' includes two propellers 46' and 46'' connected to a drive shaft 48'. The shaft 48' is drivingly connected to the motor 44' and extend radially outward from that motor. The unit 40'' includes a funnel-like element 74 to which the bag 38 is connected. The bag 38 includes hooks 76 which attach to hooks 78 on the element 74 with the opening 80 in the element 74 being fluidically connected to the interior of the bag. Stiffeners, such as rod 82, or the like, are also included to ensure proper relative orientation of the bag and the funnel-like element 74. Hooks 84 and 86 engage with each other adjacent to the rod.

As indicated in FIG. 7, fluid, in this case, oil, is drawn from the hold adjacent to the unit and into the bag through the funnel-like element as indicated in FIG. 7 by the arrows 90. The deployment of the bag using unit 40'' is indicated in FIG. 8. It is noted that a weight element 92 is attached to the bag to ensure proper deployment of that bag. The weight 92 cooperates with a water weight 94 in the bag. As is indicated in FIG. 8, the rupture is sealed by the bag after that bag moves from Stage I (partially deployed) to Stage II (fully deployed).

It is understood that while certain forms of the present invention have been illustrated and described herein, it is not to be limited to the specific forms or arrangements of parts described and shown.

I claim:

1. In a liquid-bulk carrier cargo ship having a hold defined in part by a hull portion and a deck portion of the ship, a pumping system fluidically connected to the hold by an intake conduit and an offloading conduit for loading and offloading fluid to and from the ship, and a tank hatch in the deck portion connecting the hold to the environs surrounding the ship, the improvement in combination therewith comprising:

a method for preventing liquid stored in the hold from leaking out of that hold through a rupture in the hull, said method comprising steps of:

(1) opening the tank hatch, (2) providing a flexible, liquid-proof bag large enough to cover at least that portion of the hull located between the tank hatch and said rupture in the hull, the bag having a bag mouth through which fluid moves into or out of said bag, (3) moving said bag through said tank hatch and into the fluid contained in the hold, (4) sealing said bag mouth to the tank hatch, and fluidically connecting the interior of said bag to the environs surrounding the deck, said bag being impervious to the fluid contained in the hold, (5) fluidically connecting the ship offloading conduit to said bag mouth via the tank hatch, (6) operating the ship pumping system and pumping fluid from the ship hold into said bag.

2. The improvement defined in claim 1 further including a step of deploying said bag into the ship hold as fluid is pumped into said bag.

3. The improvement defined in claim 2 wherein said method further includes a step of continuing the pumping of fluid into said bag and deploying said bag until said bag covers the rupture in the hull.

4. The improvement defined in claim 3 further including a step of stopping the pumping of fluid into said bag as soon as said bag covers the rupture in the hull.

5. In a liquid-bulk carrier cargo ship having a hold defined in part by a hull portion and a deck portion of the ship, a pumping system fluidically connected to the hold by an intake conduit and an offloading conduit for loading and offloading fluid to and from the ship, and a tank hatch in the deck portion connecting the hold to the environs surrounding the ship, the improvement in combination therewith comprising:

a means for preventing liquid stored in the hold from leaking out of that hold through a rupture in the hull, said means comprising:

(1) a housing, said housing being sized to fit into the ship hold through the tank hatch, (2) a fluid pump mounted on said housing, said fluid pump having an inlet and an outlet, (3) a flexible liquid-proof bag mounted on said housing in fluid connection with said fluid pump outlet, (4) a support element mounted on said housing, and (5) means for connecting said fluid pump to a power source.

6. The improvement defined in claim 5 further including a funnel-like element located between said pump and said bag.

7. The improvement defined in claim 6 wherein said pump includes two propellers.

8. The improvement defined in claim 7 further including hooks connecting said bag to said housing.

9. The improvement defined in claim 6 wherein said bag is formed of Spectra fibers.

10. The improvement defined in claim 5 further including a plurality of panels hingeably attached to said housing and engaging said bag.

11. The improvement defined in claim 10 further including a strap encircling said panels, said strap including releasable means fastening one end of said strap to another end of said strap.

* * * * *